US007559803B2

(12) United States Patent
Mukai et al.

(10) Patent No.: US 7,559,803 B2
(45) Date of Patent: Jul. 14, 2009

(54) CONNECTION STRUCTURE AND SIGNAL TRANSMISSION CABLE

(75) Inventors: Koichi Mukai, Ishikawa (JP); Yoshitaka Yoshino, Tokyo (JP); Chisato Komori, Ishikawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 12/033,605

(22) Filed: Feb. 19, 2008

(65) Prior Publication Data

US 2008/0207061 A1 Aug. 28, 2008

(30) Foreign Application Priority Data

Feb. 22, 2007 (JP) ..... 2007-042601

(51) Int. Cl.
*H01R 13/66* (2006.01)

(52) U.S. Cl. ..... 439/620.09

(58) Field of Classification Search ..... 439/620.09, 439/620.01, 620.21, 620.22
See application file for complete search history.

(56) References Cited

U.S. PATENT DOCUMENTS

| | | | | |
|---|---|---|---|---|
| 3,967,195 | A * | 6/1976 | Averitt et al. | 324/508 |
| 5,192,231 | A * | 3/1993 | Dolin, Jr. | 439/620.21 |
| 6,227,911 | B1 * | 5/2001 | Boutros et al. | 439/620.18 |
| 6,231,397 | B1 | 5/2001 | de la Borbolla et al. | |
| 6,379,157 | B1 * | 4/2002 | Curry et al. | 439/676 |
| 6,428,361 | B1 * | 8/2002 | Imschweiler et al. | 439/676 |
| 6,881,096 | B2 * | 4/2005 | Brown et al. | 439/620.01 |
| 2003/0082952 | A1 * | 5/2003 | Miles | 439/620 |
| 2003/0211782 | A1 * | 11/2003 | Esparaz et al. | 439/620 |
| 2005/0181643 | A1 * | 8/2005 | Brower et al. | 439/76.1 |
| 2005/0197012 | A1 * | 9/2005 | Ferentz | 439/620 |
| 2005/0277339 | A1 * | 12/2005 | Caveney et al. | 439/676 |

FOREIGN PATENT DOCUMENTS

| | | |
|---|---|---|
| JP | 04-028184 | 1/1992 |
| JP | 09-331209 | 12/1997 |
| JP | 2003-522368 | 7/2003 |
| JP | 2003-264487 | 9/2003 |
| JP | 2005-064742 | 3/2005 |
| JP | 2006-338957 | 12/2006 |

OTHER PUBLICATIONS

Japanese Office Action issued on Dec. 16, 2008.

* cited by examiner

*Primary Examiner*—Neil Abrams
*Assistant Examiner*—Harshad C Patel
(74) *Attorney, Agent, or Firm*—Sonnenschein Nath & Rosenthal LLP

(57) ABSTRACT

A connection structure includes a plug assembly including at least three plug terminals, and a jack assembly including at least three jack terminals associated with and connected to the plug terminals, wherein the plug assembly and the jack assembly form a multi-pin connector section configured to transmit and receive a signal. At least one pair of plug terminals of the plug terminals in the plug assembly is capacitively coupled in parallel to form a capacitively-coupled plug terminal, and at least one pair of jack terminals of the jack terminals in the jack assembly, the pair of jack terminals being associated with and connected to the pair of plug terminals, is capacitively coupled in parallel to form a capacitively-coupled jack terminal. The capacitively-coupled plug terminal and the capacitively-coupled jack terminal are connected to transmit and receive a high-frequency signal.

5 Claims, 13 Drawing Sheets

| JACK TERMINAL 9 | PLUG TERMINAL 8 | FUNCTION |
|---|---|---|
| 9A | 8A | USED FOR ANT |
| 9B | 8B | N.C.: OPEN |
| 9C | 8C | USED FOR STEREO/MONAURAL DETECTION |
| 9D | 8D | USED FOR R-CHANNEL AUDIO |
| 9E | 8E | USED FOR L-CHANNEL AUDIO |
| 9F | 8F | USED FOR CONNECTOR CONNECTION DETECTION |
| 9G | 8G | N.C.: OPEN |
| 9H | 8H | N.C.: OPEN |
| 9I | 8I | N.C.: OPEN |
| 9J | 8J | GND |

FIG. 10

| FREQ [MHz] | EXISTING TRANSMISSION CABLE | MULTI-PIN CONNECTOR SECTION 35 (B) | MULTI-PIN CONNECTOR SECTION 22 (A) | IMPROVED AMOUNT B | IMPROVED AMOUNT A |
|---|---|---|---|---|---|
| 50 | -0.30 | -0.45 | -0.43 | -0.15 | -0.13 |
| 100 | -0.81 | -0.82 | -0.93 | -0.01 | -0.12 |
| 200 | -1.48 | -1.10 | -0.83 | 0.38 | 0.65 |
| 300 | -1.25 | -1.04 | -0.85 | 0.21 | 0.40 |
| 400 | -1.93 | -0.98 | -0.74 | 0.95 | 1.19 |
| 500 | -4.01 | -2.37 | -1.48 | 1.64 | 2.53 |
| 600 | -3.87 | -2.17 | -1.48 | 1.70 | 2.39 |
| 700 | -6.05 | -1.53 | -1.19 | 4.52 | 4.86 |
| 800 | -14.11 | -3.72 | -2.30 | 10.39 | 11.81 |
| 900 | -5.79 | -4.00 | -2.96 | 1.79 | 2.83 |

--PRIOR ART--

--PRIOR ART--

FIG. 15 --PRIOR ART--
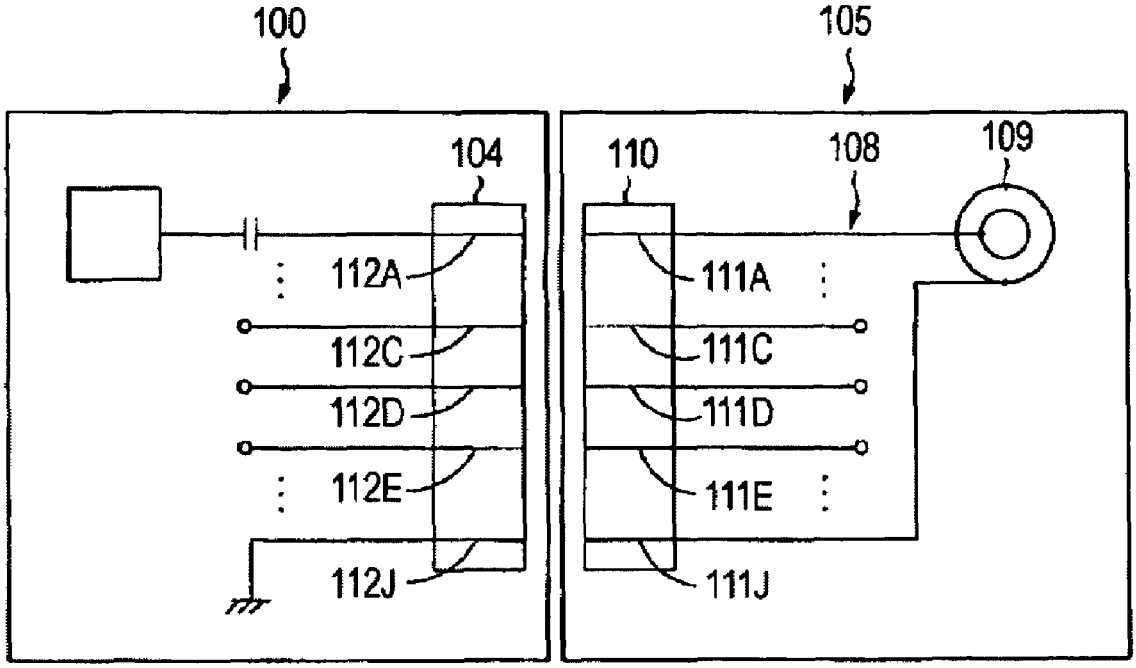
FIG. 16
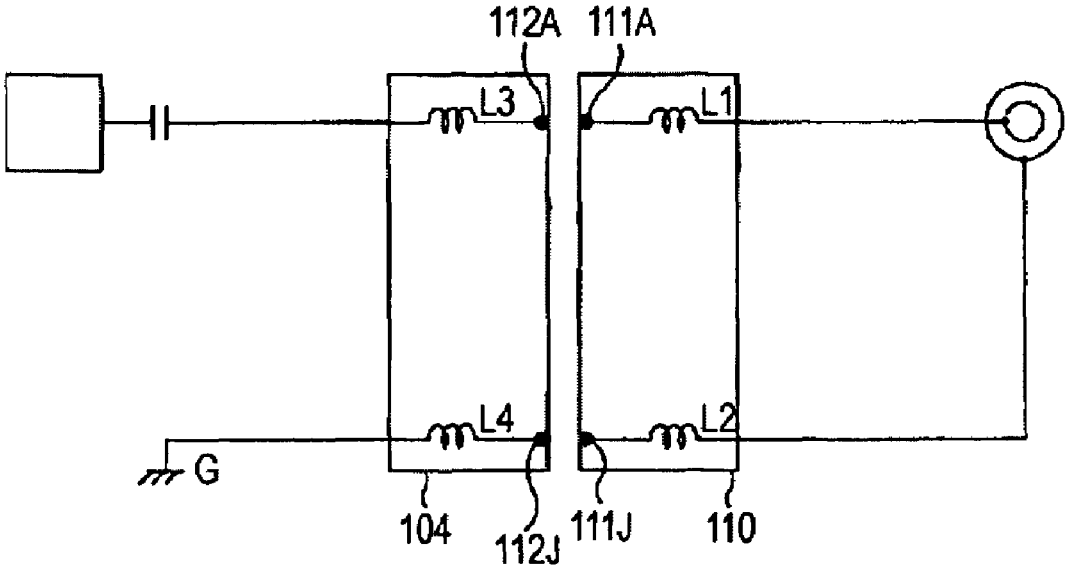

CONNECTION STRUCTURE AND SIGNAL TRANSMISSION CABLE

CROSS REFERENCES TO RELATED APPLICATIONS

The present invention contains subject matter related to Japanese Patent Application JP 2007-042601 filed in the Japanese Patent Office on Feb. 22, 2007, the entire contents of which are incorporated herein by reference.

BACKGROUND OF THE INVENTION

1. Field of the Invention

The present invention relates to a connection structure of a multi-pin connector section located between electronic apparatuses to transmit and receive various signals, direct-current (DC) voltages, and the like, and a signal transmission cable for connecting electronic apparatuses to transmit and receive various signals, DC voltages, and the like.

2. Description of the Related Art

Various portable information terminal units have been designed to be compact, lightweight, and multi-functional. Such units also have a function for simultaneously processing a high-frequency signal and a low-frequency signal such as a speech signal or an audio signal. For example, mobile phones typically equipped with camera functions and various information terminal functions as well as calling functions are now positioned as integrated portable terminal devices, rather than mere calling devices, in a market. With the start of terrestrial digital television broadcasting for portable terminals, the mobile phones have been further provided with a tuner function to serve as television broadcast receiving terminal units. For example, mobile phones having an internal high-capacity storage unit such as a hard disk and having a capability of storing a television broadcast program received via a television receiver to allow a user to reproduce and view the stored television broadcast program as desired have also become available.

Referring to FIG. 13, in a mobile phone 100 having a function of a television broadcast receiving terminal, it has been proposed that, instead of an internal communication antenna, an earphone antenna 101 is used as a wideband external antenna to allow improved reception of broadcast waves. The earphone antenna 101 includes, as antenna elements, earphone cords 103R and 103L having earphones 102R and 102L, respectively. The earphone antenna 101 is detachable from an input/output terminal section 104 of the mobile phone 100 via a signal transmission cable (hereinafter referred to as a "transmission cable") 105. The mobile phone 100 is connected to the earphone antenna 101 via the transmission cable 105, thereby transmitting and receiving a speech signal or an audio signal and receiving a television broadcast wave (radio-frequency (RF) signal).

The mobile phone 100 is connected to the earphone antenna 101 using the transmission cable 105 to transmit and receive a speech signal and an RF signal to and from the earphone antenna 101. In the mobile phone 100, as disclosed in, for example, Japanese Unexamined Patent Application Publication No. 2005-64742, the transmission cable 105 may be a dedicated coaxial transmission cable with high transmission characteristics for an RF signal. Such a coaxial transmission cable is relatively expensive and is inconvenient to lay due to the large diameter of coaxial cables. Furthermore, such a coaxial transmission cable does not support other functions.

The mobile phone 100 may have a function for recording a television program in an internal memory. In this case, referring to FIG. 14, the mobile phone 100 also has a function for loading a broadcast program stored in a television receiver 106 into the internal memory. The mobile phone 100 is further capable of outputting a broadcast program stored in the internal memory to the television receiver 106 to allow a user to view the program on a large screen. The mobile phone 100 is connected to the television receiver 106 by connecting the transmission cable 105 connected to the input/output terminal section 104 to an external input/output terminal section 107 in the manner shown in FIG. 14. The mobile phone 100 transmits and receives video and audio signals to and from the television receiver 106 via the transmission cable 105. The mobile phone 100 stores a broadcast program retrieved from the television receiver 106 in the inside of the mobile phone 100 to allow a user to reproduce and view the stored broadcast program as desired.

Referring to FIG. 15, the transmission cable 105 includes a multi-core cable 108, a high-frequency connector section 109 provided at an end of the multi-core cable 108 and detachably attached to the input/output terminal section 104 of the mobile phone 100 or the external input/output terminal section 107 of the television receiver 106, and a plug section 110 provided at the other end of the multi-core cable 108 and detachably attached to the input/output terminal section 104 of the mobile phone 100. The plug section 110 of the transmission cable 105 includes, for example, 10-pin plug terminals 111A to 111J (hereinafter collectively referred to as "plug terminals 111" unless otherwise individually identified). The 10-pin plug terminals 111A to 111J are connected to jack terminals 112A to 112J (hereinafter collectively referred to as "jack terminals 112" unless otherwise individually identified) provided at the input/output terminal section 104 of the mobile phone 100 in association therewith, respectively, to form a multi-pin connector section. The transmission cable 105 has a terminal pattern into which, for example, the plug terminals 111 is formed on a substrate. However, the transmission cable 105 may have an appropriate terminal configuration of pin terminals or the like.

The plug terminals 111 of the transmission cable 105, each of which is provided with a predetermined function, are connected to the associated jack terminals 112 of the mobile phone 100. For example, the plug terminal 111A, which is used for an antenna feeder, is connected to the jack terminal 112A, which is used for an antenna feeder, and the plug terminal 111J, which is used for grounding, is connected to the jack terminal 112J, which is used for grounding, so that an RF signal (high-frequency signal) is transmitted and received between the mobile phone 100 and the earphone antenna 101 via the transmission cable 105. For example, the plug terminal 111C, which is used for stereo/monaural detection, is connected to the jack terminal 112C, which is used for stereo/monaural detection, so that a stereo/monaural detection signal is transmitted and received via the transmission cable 105. For example, the plug terminal 111D, which is used for right-channel (R-channel) audio, and the plug terminal 111E, which is used for left-channel (L-channel) audio, are connected to the jack terminal 112D, which is used for R-channel audio, and the jack terminal 112E, which is used for L-channel audio, respectively, so that an audio signal is transmitted and received via the transmission cable 105.

SUMMARY OF THE INVENTION

The existing transmission cable 105 is designed specifically for transmission of audio and digital signals. In a use case where, as described above, the transmission cable 105 is connected to the mobile phone 100 and the earphone antenna 101 or the television receiver 106 to transmit and receive both an RF signal and an audio signal, a problem occurs in that transmission loss of the RF signal is generated in a connector portion to cause a degradation in transmission characteristics. In the transmission cable 105, as shown in FIG. 15, the plug terminals 111A and 111J are connected to the associated jack terminals 112A and 112J, respectively, to thereby form a multi-pin connector section for transmitting and receiving an RF signal with a multi-pin configuration. Referring to FIG. 16, the plug terminals 111A and 111J and the jack terminals 112A and 112J include inductors L1, L2, L3, and L4, respectively, and the multi-pin connector section has an equivalent circuit composed of the inductors L1 to L4.

If an inductor component in the multi-pin connector section is given by $Z=j2\pi fL$, the impedance of the transmission cable 105 gradually increases as the transmission frequency increases in the RF signal transmission connector section. As is apparent from a simulation result shown in FIG. 17, as indicated by a broken line, a transmission characteristic of the transmission cable 105 with respect to a change in the transmission frequency of the RF signal in the multi-pin connector section exhibits a gradual increase in transmission loss as the frequency band becomes higher, compared with that of an ideal loss-free transmission system indicated by a solid line shown in FIG. 17. Although the transmission cable 105 has a multi-pin connector section formed in the manner described above to transmit various signals between electronic apparatuses, there occurs a problem of causing transmission loss in the multi-pin connector section for the transmission of a high-frequency signal.

The transmission cable 105 is adapted to connect electronic apparatuses to transmit and receive various signals therebetween. The transmission cable 105 may further be provided with a band elimination filter function for transmitting only a signal having a predetermined frequency. For example, when the transmission cable 105 is connected to the mobile phone 100 and the television receiver 106 for use, the band elimination filter function filters an unwanted radio wave emitted from the mobile phone 100 to eliminate an effect on a tuner of the television receiver 106.

In a case where the transmission cable 105 is provided with the band elimination filter function, a filter element is mounted on a substrate of the plug section 110. This leads to a problem of an increase in the size of the plug section 110 and the cost of the transmission cable 105.

Transmission cables adapted to transmit both a low-frequency signal and a high-frequency signal are not limited to the transmission cable 105 used for connection between the mobile phone 100 and the earphone antenna 101 or the television receiver 106, and may include a signal transmission cable adapted to transmit a signal between various electronic apparatuses and a signal transmission cable adapted to transmit a signal within an electronic apparatus. One of such transmission cables is plugged into, for example, a hinge mechanism of a mobile phone having two pieces foldable about the hinge mechanism to transmit and receive an RF signal between the pieces. The mobile phone uses a flexible cable because it is difficult to adopt a coaxial cable configuration for an RF signal in the hinge mechanism, resulting in a problem in that transmission loss occurs in a connector section of the flexible cable.

It is therefore desirable to provide a connection structure that reduces transmission loss of a high-frequency signal in a multi-pin connector section through which various signals are transmitted and received. It is also desirable to provide a signal transmission cable that reduces transmission loss between electronic apparatuses between which various signals are transmitted and received to allow efficient transmission and reception of a high-frequency signal.

According to an embodiment of the present invention, a connection structure includes a plug assembly including at least three plug terminals, and a jack assembly including at least three jack terminals associated with and connected to the plug terminals. The plug assembly and the jack assembly form a multi-pin connector section configured to transmit and receive a signal. At least one pair of plug terminals of the plug terminals in the plug assembly is capacitively coupled in parallel to form a capacitively-coupled plug terminal, and at least one pair of jack terminals of the jack terminals in the jack assembly, the pair of jack terminals being associated with and connected to the pair of plug terminals, is capacitively coupled in parallel to form a capacitively-coupled jack terminal.

In the connection structure, the multi-pin connector section forms an equivalent circuit of an inductor component, resulting in a gradual increase in impedance in a high-frequency band to cause transmission loss. In the connection structure, a plurality of plug terminals capacitively coupled in parallel are connected to a plurality of jack terminals capacitively coupled in parallel to allow a reduction in the inductance in the multi-pin connector section to reduce transmission loss so that a high-frequency signal can be efficiently transmitted and received. In the connection structure, at least one pair of plug terminals constituting a capacitively-coupled plug terminal and at least one pair of jack terminals constituting a capacitively-coupled jack terminal are connected to reduce an inductance to allow efficient transmission and reception of a high-frequency signal. Further, each of the plug terminals and a jack terminal associated therewith form a single connection section to transmit and receive a signal other than a high-frequency signal.

In the connection structure, the capacitively-coupled plug terminal may be formed by capacitively coupling at least one pair of plug terminals of the plug terminals, the pair of plug terminals including a plug terminal for a feed line of a high-frequency signal and a selected one of the plug terminals that has another function, and the capacitively-coupled jack terminal may be formed by capacitively coupling at least one pair of jack terminals of the jack terminals, the pair of jack terminals being associated with and connected to the pair of plug terminals and including a jack terminal for a feed line of a high-frequency signal and a selected one of the jack terminals that has another function. In the connection structure, an inductance of a plug terminal and jack terminal constituting a feed line is reduced to allow efficient transmission and reception of a high-frequency signal.

In the connection structure, the capacitively-coupled plug terminal may be formed by capacitively coupling at least one pair of plug terminals of the plug terminals, the pair of plug terminals including a plug terminal for a ground line and a selected one of the plug terminals that has another function, and the capacitively-coupled jack terminal may be formed by capacitively coupling at least one pair of jack terminals of the jack terminals, the pair of jack terminals being associated with and connected to the pair of plug terminals and including a jack terminal for a ground line and a selected one of the jack terminals that has another function. In the connection structure, an inductance of a plug terminal and jack terminal constituting a ground line is reduced to enhance the ground line to allow efficient transmission and reception of a high-frequency signal.

In the connection structure, the at least one pair of plug terminals may be capacitively coupled in parallel via a plug-side capacitor to form the capacitively-coupled plug terminal, and the at least one pair of jack terminals may be capacitively coupled in parallel via a jack-side capacitor to form the capacitively-coupled jack terminal. Each of the plug-side capacitor and the jack-side capacitor may have a predetermined capacitance for forming a band elimination filter that is configured to select a predetermined frequency band using an inductance component of each of the at least one pair of plug terminals and at least one pair of jack terminals. In the connection structure, a band elimination filter that is configured to select a predetermined frequency band is formed using a capacitor having a predetermined capacitance, and a degradation in characteristics of a terminal end is prevented while the number of mounted parts is reduced.

According to another embodiment of the present invention, a signal transmission cable includes a plug section including at least three plug terminals, a high-frequency connector section configured to be connected to a connection section of an electronic apparatus to input and output a signal including a high-frequency signal, and a cable section connecting the plug section and the high-frequency connector section, wherein the plug section is configured to be connected to a jack assembly provided in the electronic apparatus to form a multi-pin connector section configured to transmit and receive a signal, the jack assembly including at least three jack terminals that are associated with the plug terminals, at least one pair of jack terminals of the jack terminals being capacitively coupled in parallel to form a capacitively-coupled jack terminal. In the signal transmission cable, a capacitively-coupled plug terminal is formed in the plug section by capacitively coupling, in parallel, at least one pair of plug terminals of the plug terminals that is associated with the pair of jack terminals capacitively coupled to form the capacitively-coupled jack terminal in the jack assembly.

In the signal transmission cable, the high-frequency connector section is connected to a first electronic apparatus and the plug section is connected to a second electronic apparatus to transmit and receive various signals including a high-frequency signal. In the signal transmission cable, the plug section is connected to the jack assembly of the electronic apparatus, thereby connecting at least one pair of plug terminals constituting a capacitively-coupled plug terminal and at least one pair of jack terminals constituting a capacitively-coupled jack terminal to allow a reduction of an inductance in a connection portion. In the signal transmission cable, transmission loss is reduced to allow efficient transmission and reception of a high-frequency signal between the electronic apparatuses. In the signal transmission cable, each of the plug terminals and a jack terminal associated therewith form a single connection section to transmit and receive a signal other than a high-frequency signal between the electronic apparatuses.

In the signal transmission cable, each of a plug-side capacitor constituting a capacitively-coupled plug terminal in the plug section, and a jack-side capacitor constituting a capacitively-coupled jack terminal in the jack assembly of the electronic apparatus may be a capacitor having a predetermined capacitance, thereby forming a band elimination filter that is configured to select a predetermined frequency band in a state where the plug section is connected to the jack assembly. In the signal transmission cable, therefore, degradation in characteristics of a terminal end together with the jack assembly is prevented, and the number of mounted parts is reduced.

According to an embodiment of the present invention, inductor components of each set of terminals associated with and connected to each other constitute an equivalent circuit. Therefore, in a multi-pin connector section configured to transmit and receive various signals including a high-frequency signal, for which impedance is high in a high-frequency band, at least one pair of plug terminals is capacitively coupled in parallel to form a capacitively-coupled plug terminal, and at least one pair of jack terminals that is associated with and connected to the pair of plug terminals is capacitively coupled in parallel to form a capacitively-coupled jack terminal, thereby reducing the inductance to allow efficient transmission and reception of a high-frequency signal. Furthermore, a signal other than a high-frequency signal is also transmitted and received via each of plug terminals and a jack terminal associated therewith. According to an embodiment of the present invention, a multi-pin connector section can be formed with a simple structure without independently forming a connection section for a high-frequency signal, and a band elimination filter configured to select a predetermined frequency band can also be formed.

BRIEF DESCRIPTION OF THE DRAWINGS

FIG. 10 is a table showing the characteristic evaluation;

FIG. 15 is a schematic diagram of a multi-pin connector section that is formed by connecting an existing transmission cable to a mobile phone;

FIG. 16 is a diagram showing an equivalent circuit formed in the existing multi-pin connector section.

DESCRIPTION OF THE PREFERRED EMBODIMENTS

Figure 13:
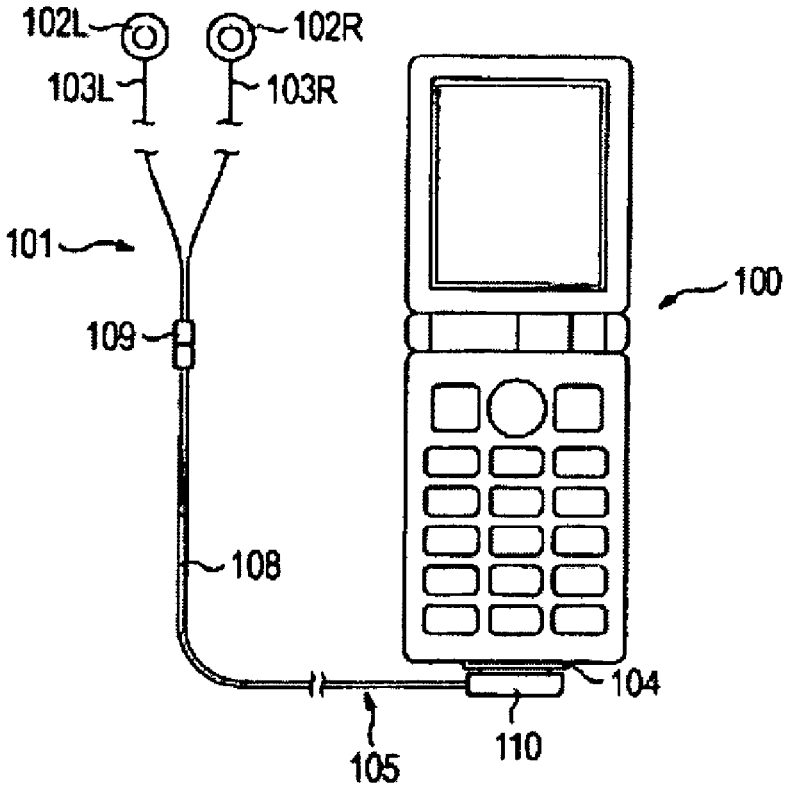
FIG. 13 is a diagram showing a use state of a signal transmission cable connecting an earphone antenna to a mobile phone.

An embodiment of the present invention will be described in detail with reference to the drawings. A signal transmission cable device (hereinafter referred to as a "transmission cable") 1 according to the embodiment is configured to connect various electronic apparatuses to efficiently transmit and receive various signals including a high-frequency signal. For example, Referring to FIG. 1, the transmission cable 1 connects a mobile phone 5 and an antenna socket 16 to which an earphone antenna such as the earphone antenna 101 shown in FIG. 13 and various antennas 15 such as an outdoor antenna and an indoor antenna are connected, thus allowing a user to receive a television broadcast program to comfortably view the program on the mobile phone 5. Similarly to the existing transmission cable 105 described above, the transmission cable 1 also has a capability of connecting the mobile phone 5 to other apparatuses such as a television receiver and a personal computer to transmit and receive various signals therebetween.

Figures 2, 3:
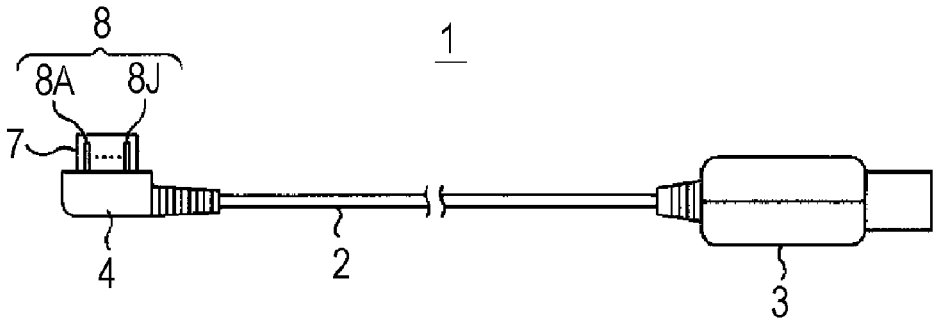
FIG. 2 is a partial front view of the transmission cable.
FIG. 3 is a functional diagram of plug terminals provided in a plug section of the transmission cable and jack terminals provided in an input/output terminal section of the mobile phone.

The transmission cable 1 has a basic configuration similar to that of the existing transmission cable 105 described above. Referring to FIG. 2, the transmission cable 1 is formed of, for example, a 10-pin multi-core cable assembly including a multi-core cable 2, a high-frequency connector section 3 provided at an end of the multi-core cable 2 and detachably attached to the antenna socket 16, and a plug section 4 provided at the other end of the multi-core cable 2 and detachably attached to an input/output terminal section 6 of the mobile phone 5.

Also in the transmission cable 1, although not shown, the plug section 4 includes 10-pin plug terminals 8A to 8J (hereinafter collectively referred to as "plug terminals 8" unless otherwise individually identified) that are formed as a pattern on substrate 7. The plug terminals 8 are connected to core wires of the multi-core cable 2, and the substrate 7 is accommodated in an insulating case with the plug terminals 8 exposed. The plug terminals 8A to 8J of the transmission cable 1, each of which is provided with a predetermined function, are connected to jack terminals 9A to 9J (hereinafter collectively referred to as "jack terminals 9" unless otherwise individually identified) provided in association therewith in the mobile phone 5, respectively.

For example, the plug terminals 8 of the transmission cable 1 are individually assigned functions shown in FIG. 3 for use. Specifically, the first plug terminal 8A functions as an antenna plug terminal for feeding a high-frequency signal; the third plug terminal 8C functions as a stereo/monaural detection plug terminal through which a stereo/monaural detection signal flows; the fourth plug terminal 8D functions as an R-channel audio plug terminal through which an R-channel audio signal flows; the fifth plug terminal 8E functions as an L-channel audio plug terminal through which an L-channel audio signal flows; the sixth plug terminal 8F functions as a connection-detection plug terminal through which a connection-detection signal flows; and the tenth plug terminal 8J functions as a grounding terminal that is connected to a ground G. The transmission cable 1 is used in the above-described use states, and the remaining plug terminals 8B, 8G, 8H, and 8I are open terminals.

In the mobile phone 5, the jack terminals 9 of the input/output terminal section 6 are also assigned functions associated with those of the plug terminals 8 described above, and are connected to the plug terminals 8 when the mobile phone 5 is connected to the transmission cable 1 for use. Specifically, the first jack terminal 9A associated with the first plug terminal 8A functions as an antenna jack terminal; the third jack terminal 9C associated with the third plug terminal 8C functions as a stereo/monaural detection plug terminal; the fourth jack terminal 9D associated with the fourth plug terminal 8D functions as an R-channel audio plug terminal; the fifth jack terminal 9E associated with the fifth plug terminal 8E functions as an L-channel audio plug terminal; the sixth jack terminal 9F associated with the sixth plug terminal 8F functions as a connection-detection plug terminal; and the tenth jack terminal 9J associated with the tenth plug terminal 8J functions as a grounding terminal that is connected to the ground G. The remaining jack terminals 9B, 9G, 9H, and 9I of the jack terminals 9 are open terminals.

In the transmission cable 1, as described above, the plug section 4 is connected to the input/output terminal section 6 of the mobile phone 5 so that the plug section 4 and the input/output terminal section 6 form a multi-pin connector section 10 configured to transmit and receive a high-frequency signal (RF signal) and a low-frequency signal (audio signal) or various detection signals between the individually connected plug terminals 8 and jack terminals 9.

The multi-pin connector section 10 is configured such that, as described above, inductor components of the plug terminals 8 and inductor components of the jack terminals 9 form an equivalent circuit, and an inductor component given by $Z=j2\pi fL$ in an RF signal transmission system causes a gradual increase in impedance to cause transmission loss as the frequency band becomes higher. In the multi-pin connector section 10, capacitively-coupled plug terminals and capacitively-coupled jack terminals described below are provided to allow a reduction of the inductance of the plug terminals 8 and the jack terminals 9 without any effect on transmission and reception of an audio signal or a detection signal to improve the transmission characteristics. In addition, the ground line is enhanced to allow efficient transmission of an RF signal.

Figure 1:
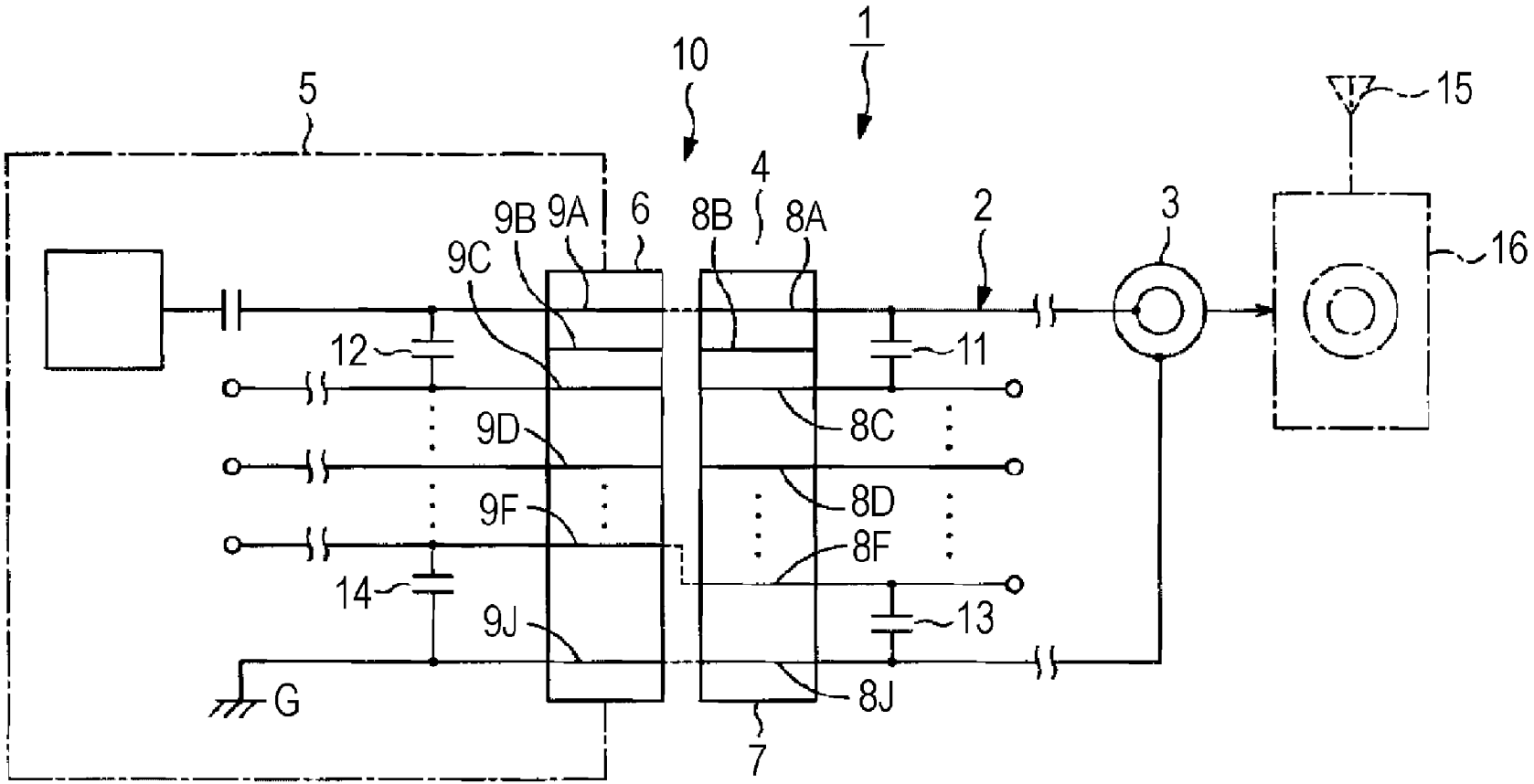
FIG. 1 is a schematic diagram of an application example in which a mobile phone and an antenna are connected via a transmission cable according to a first embodiment of the present invention.
Figure 4:
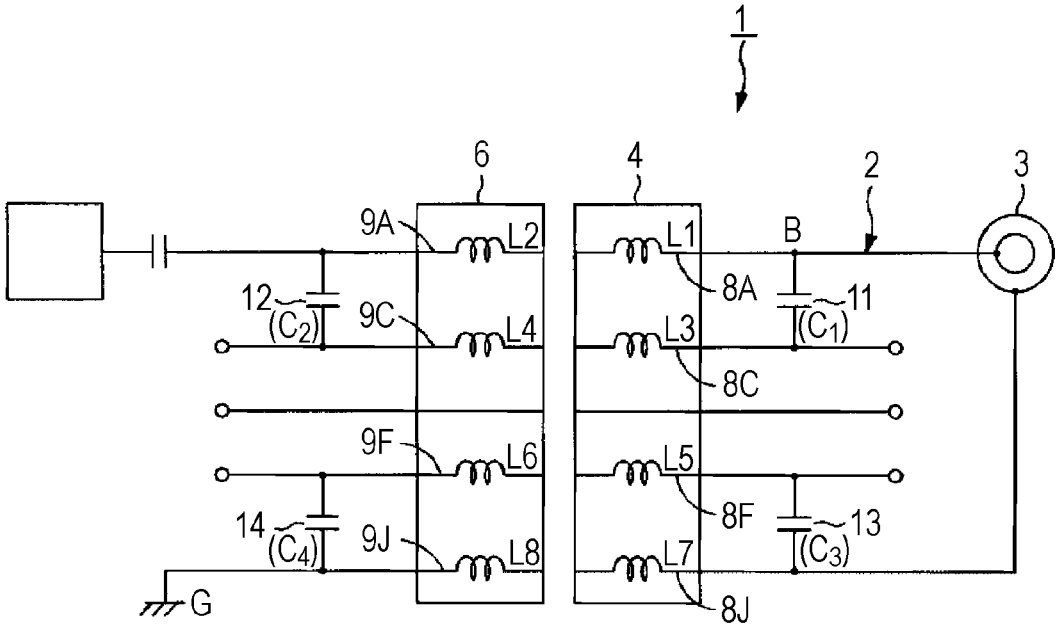
FIG. 4 is a diagram of an equivalent circuit formed in a multi-pin connector section.

As shown in FIGS. 1 and 4, in the multi-pin connector section 10, a capacitively-coupled plug terminal is formed in the plug section 4 of the transmission cable 1 by capacitively coupling the first plug terminal 8A, which is an antenna plug terminal for feeding an RF signal, and the third plug terminal 8C, which is a stereo/monaural detection plug terminal, in parallel via a first capacitor 11. In the multi-pin connector section 10, a capacitively-coupled jack terminal is also formed in the input/output terminal section 6 of the mobile phone 5 by capacitively coupling the first jack terminal 9A, which is an antenna jack terminal for feeding an RF signal, and the third jack terminal 9C, which is a stereo/monaural detection jack terminal, in parallel via a second capacitor 12. In the multi-pin connector section 10, each of the first and second capacitors 11 and 12 may be a capacitor with a capacitance of, for example, 10 pF to 10000 pF.

In the multi-pin connector section 10, therefore, the capacitively-coupled plug terminal formed by capacitively coupling, in parallel, the first and third plug terminals 8A and 8C is connected to the capacitively-coupled jack terminal associated therewith formed by capacitively coupling, in parallel, the first and third jack terminals 9A and 9C, thereby establishing an RF signal transmission path in the plug section 4 of the transmission cable 1 and the input/output terminal section 6 of the mobile phone 5. The resulting RF signal transmission path allows transmission and reception of an RF signal with a half-reduced inductance of the plug terminals 8 and the jack terminals 9. In the multi-pin connector section 10, a stereo/ monaural detection signal, which is a DC signal, flowing between the connected third plug terminal 8C and third jack terminal 9C is filtered by the first and second capacitors 11 and 12 with respect to the first plug terminal 8A and the first jack terminal 9A. In the multi-pin connector section 10, therefore, there is no effect on a transmission system of a stereo/monaural detection signal.

In the multi-pin connector section 10, as described above, an RF signal transmission path with a reduced inductance is formed by the capacitively-coupled plug terminals 8A and 8C of the transmission cable 1 and the capacitively-coupled jack terminals 9A and 9C of the mobile phone 5, thereby reducing transmission loss to allow efficient transmission and reception of an RF signal. In the multi-pin connector section 10, the plug terminal 8C and jack terminal 9C, which do not relate to an RF signal transmission system, are selected and capacitively coupled to the first plug terminal 8A and the first jack terminal 9A, respectively. However, it is to be understood that the configuration of the multi-pin connector section 10 is not limited to the above-described configuration. The multi-pin connector section 10 may be configured such that a plurality of other plug terminals 8 and jack terminals 9 that do not relate to an RF signal transmission system may be selected and capacitively coupled in parallel.

The multi-pin connector section 10 is configured such that, in addition to the above-described reduction in inductance of the plug terminals 8 and the jack terminals 9, the ground line is enhanced to more efficiently transmit and receive an RF signal. As shown in FIGS. 1 and 4, in the multi-pin connector section 10, a capacitively-coupled grounding plug terminal is formed in the plug section 4 of the transmission cable 1 by capacitively coupling the tenth plug terminal 8J, which is a grounding plug terminal for an RF signal, and the sixth plug terminal 8F, which is a connection-detection plug terminal for detecting a connection with the mobile phone 5, in parallel via a third capacitor 13. In the multi-pin connector section 10, a capacitively-coupled grounding jack terminal is also formed in the input/output terminal section 6 of the mobile phone 5 by capacitively coupling the tenth jack terminal 9J, which is a grounding plug terminal for an RF signal, and the sixth jack terminal 9F, which is a connection-detection jack terminal for detecting a connection with the transmission cable 1, in parallel via a fourth capacitor 14. In the multi-pin connector section 10, each of the third and fourth capacitors 13 and 14 may also be a capacitor with a capacitance of, for example, 10 pF to 10000 pF.

In the multi-pin connector section 10, therefore, the capacitively-coupled grounding plug terminal formed by capacitively coupling, in parallel, the tenth and sixth plug terminals 8J and 8F is connected to the capacitively-coupled grounding jack terminal associated therewith formed by capacitively coupling, in parallel, the tenth and sixth jack terminals 9J and 9F, thereby establishing an RF signal transmission path in the plug section 4 of the transmission cable 1 and the input/output terminal section 6 of the mobile phone 5. The resulting RF signal transmission path allows transmission and reception of an RF signal with a half-reduced inductance of the grounding plug terminal and the grounding jack terminal, and enhances the ground path to efficiently transmit and receive an RF signal.

In the multi-pin connector section 10, a connection-detection signal, which is a DC signal, flowing between the connected sixth plug terminal 8F and sixth jack terminal 9F is filtered by the third and fourth capacitors 13 and 14 with respect to the tenth plug terminal 8J and the tenth jack terminal 9J and is not therefore transferred to the ground G. In the multi-pin connector section 10, therefore, there is no effect on a transmission system of a connection-detection signal. In the multi-pin connector section 10, the sixth plug terminal 8F and sixth jack terminal 9F, which do not relate to an RF signal transmission system, are selected and capacitively-coupled to the tenth plug terminal 8J and tenth jack terminal 9J, which are for grounding, respectively. However, it is to be understood that the configuration of the multi-pin connector section 10 is not limited to the above-described configuration. The multi-pin connector section 10 may be configured such that a plurality of other plug terminals 8 and jack terminals 9, which do not relate to an RF signal transmission system, may be selected and capacitively coupled in parallel to form a capacitively-coupled grounding plug terminal and a capacitively-coupled grounding jack terminal.

Figure 5:
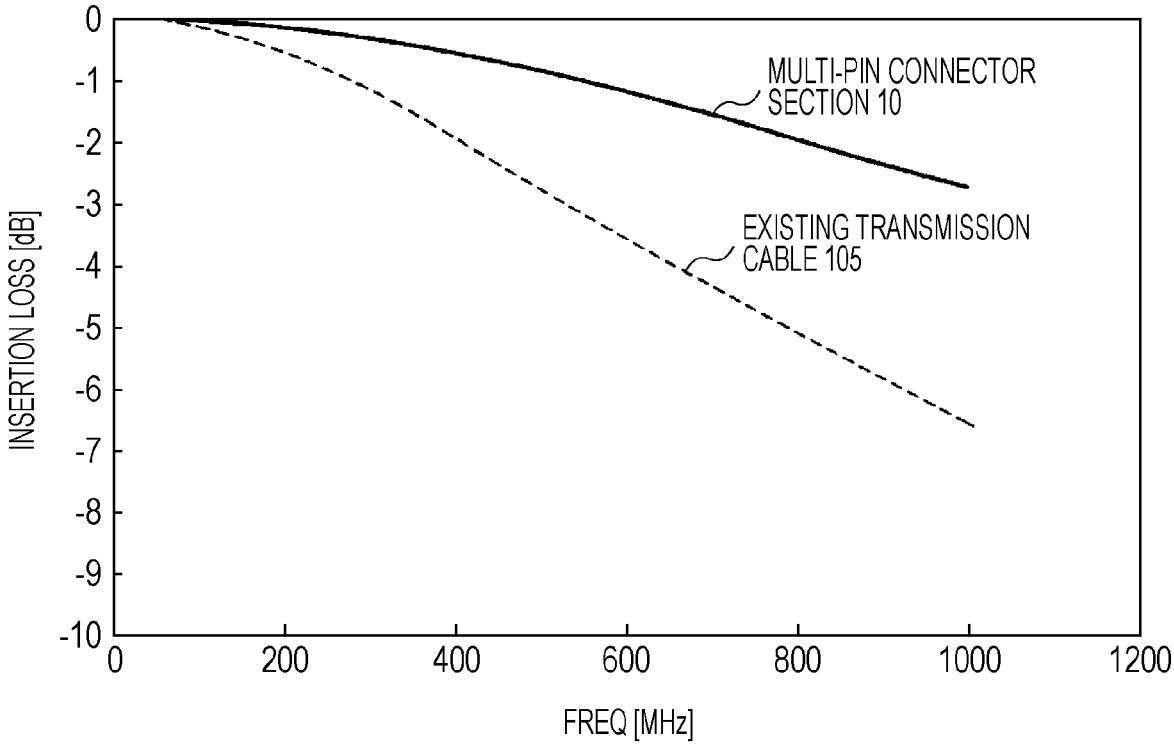
FIG. 5 is a diagram showing a simulation result of a change in transmission characteristics of the multi-pin connector section in accordance with a change in the transmission frequency of an RF signal.

Also in the multi-pin connector section 10, as shown in FIG. 4, the plug terminals 8 of the plug section 4 and the jack terminals 9 of the input/output terminal section 6 are connected to form an equivalent circuit including inductor components L of the plug terminals 8 and jack terminals 9. If each of the inductor components L of the plug terminals 8 and jack terminals 9 has an inductance of 15 nH and each of the first to fourth capacitors 11 to 14 has a capacitance of 1000 pF, the multi-pin connector section 10 obtains a simulation result indicated by a solid line shown in FIG. 5. FIG. 5 shows a simulation result of a change in transmission characteristics (transmission loss) in accordance with a change in the transmission frequency of an RF signal. The multi-pin connector section 10 has an efficiency of approximately 3 dB for a change in transmission characteristics over a use frequency band (470 MHz to 690 MHz) of terrestrial digital television broadcasting compared with that of the existing transmission cable 105 indicated by a broken line shown in FIG. 5.

As described above, the multi-pin connector section 10 forms a set of a capacitively-coupled plug terminal and a capacitively-coupled jack terminal, and a set of a capacitively-coupled grounding plug terminal and a capacitively-coupled grounding jack terminal using the first to fourth capacitors 11 to 14. The multi-pin connector section 10 connects the first to fourth capacitors 11 to 14 to the plug terminals 8 and the jack terminals 9 via a connection pattern formed on the substrate 7 of the plug section 4 and a connection pattern formed on a substrate of the input/output terminal section 6. The multi-pin connector section 10 may be configured such that the first to fourth capacitors 11 to 14 are mounted as chip parts in the plug section 4 and the input/output terminal section 6. Although the multi-pin connector section 10 includes the first to fourth capacitors 11 to 14, the size of the plug section 4 or the input/output terminal section 6 is not increased or the cost of the multi-pin connector section 10 is not increased.

Figure 6:
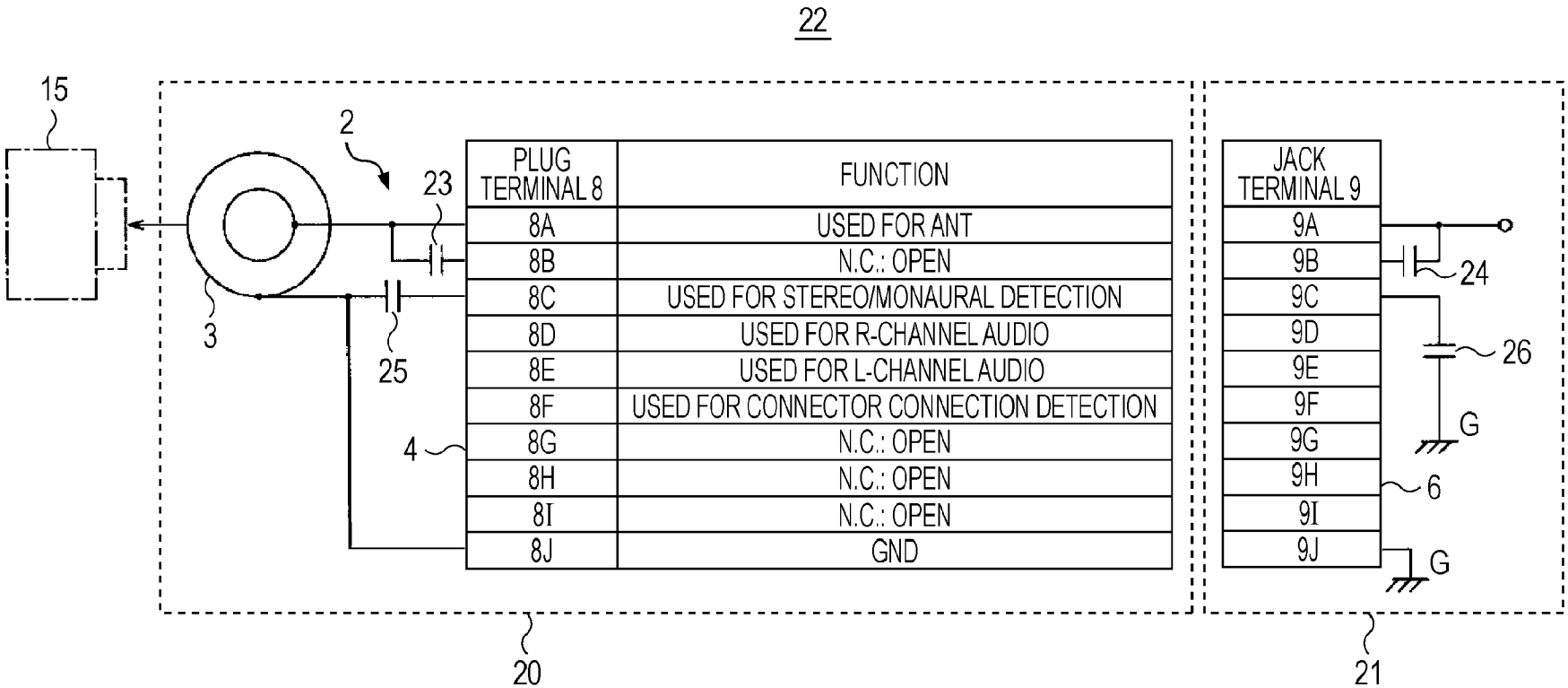
FIG. 6 is a schematic diagram of an application example in which a mobile phone and an antenna are connected via a transmission cable according to a second embodiment of the present invention.

FIG. 6 shows an application example according to a second embodiment of the present invention in which a mobile phone 21 having a basic configuration similar to that of the mobile phone 5 described above and an antenna 15 are connected using a transmission cable 20 having a basic configuration similar to that of the transmission cable 1 described above. Also in the second embodiment, an inductance of plug terminals 8 and jack terminals 9 that form a multi-pin connector section 22 is reduced, and the ground line is enhanced to allow efficient transmission and reception of an RF signal. In the second embodiment, components corresponding to those of the first embodiment described above are denoted by the same reference numerals, and a description thereof is thus omitted.

In the multi-pin connector section 22 according to the second embodiment, as shown in FIG. 6, a capacitively-coupled plug terminal is formed in the transmission cable 20 by capacitively coupling the second plug terminal 8B, which is an open terminal, in parallel to the first plug terminal 8A for feeding an RF signal via a fifth capacitor 23. In the multi-pin connector section 22, a capacitively-coupled jack terminal is also formed in the mobile phone 21 by capacitively coupling the second jack terminal 9B, which is an open terminal and which is connected to the second plug terminal 8B, in parallel to the first jack terminal 9A, which is connected to the first plug terminal 8A for feeding an RF signal, via a sixth capacitor 24.

In the multi-pin connector section 22, the plug section 4 of the transmission cable 20 is connected to the input/output terminal section 6 of the mobile phone 21 in the manner described above to thereby reduce the inductance between the plug terminals 8 and jack terminals 9 constituting an RF signal feed line that is formed by connecting the individually connected capacitively-coupled plug terminal and capacitively-coupled jack terminal. In the multi-pin connector section 22, even if the second jack terminal 9B, which is an open terminal, is assigned a certain function when the mobile phone 21 is connected to another device, the sixth capacitor 24 allows a signal flowing in the second jack terminal 9B to be filtered with respect to the first jack terminal 9A.

In the multi-pin connector section 22, a capacitively-coupled grounding plug terminal is further formed in the transmission cable 20 by capacitively coupling the third plug terminal 8C, which is used for stereo/monaural detection, in parallel to the tenth plug terminal 8J via a seventh capacitor 25. In the multi-pin connector section 22, a capacitively-coupled grounding jack terminal is also formed in the mobile phone 21 by capacitively coupling the third jack terminal 9C connected to the third plug terminal 8C, which is used for stereo/monaural detection, in parallel to the tenth jack terminal 9J connected to the tenth plug terminal 8J via an eighth capacitor 26.

In the multi-pin connector section 22, the plug section 4 of the transmission cable 20 is connected to the input/output terminal section 6 of the mobile phone 21 in the manner described above to thereby reduce the inductance between the plug terminals 8 and jack terminals 9 constituting an RF signal ground line that is formed by connecting the individually connected capacitively-coupled grounding plug terminal and capacitively-coupled grounding jack terminal to enhance the ground line in the RF signal transmission path. In the multi-pin connector section 22, a stereo/monaural detection signal, which is a DC signal, flowing between the third plug terminal 8C and third jack terminal 9C, which are used for stereo/monaural detection, is filtered by the seventh and eighth capacitors 25 and 26 and is not transferred to the ground G.

Figure 7:
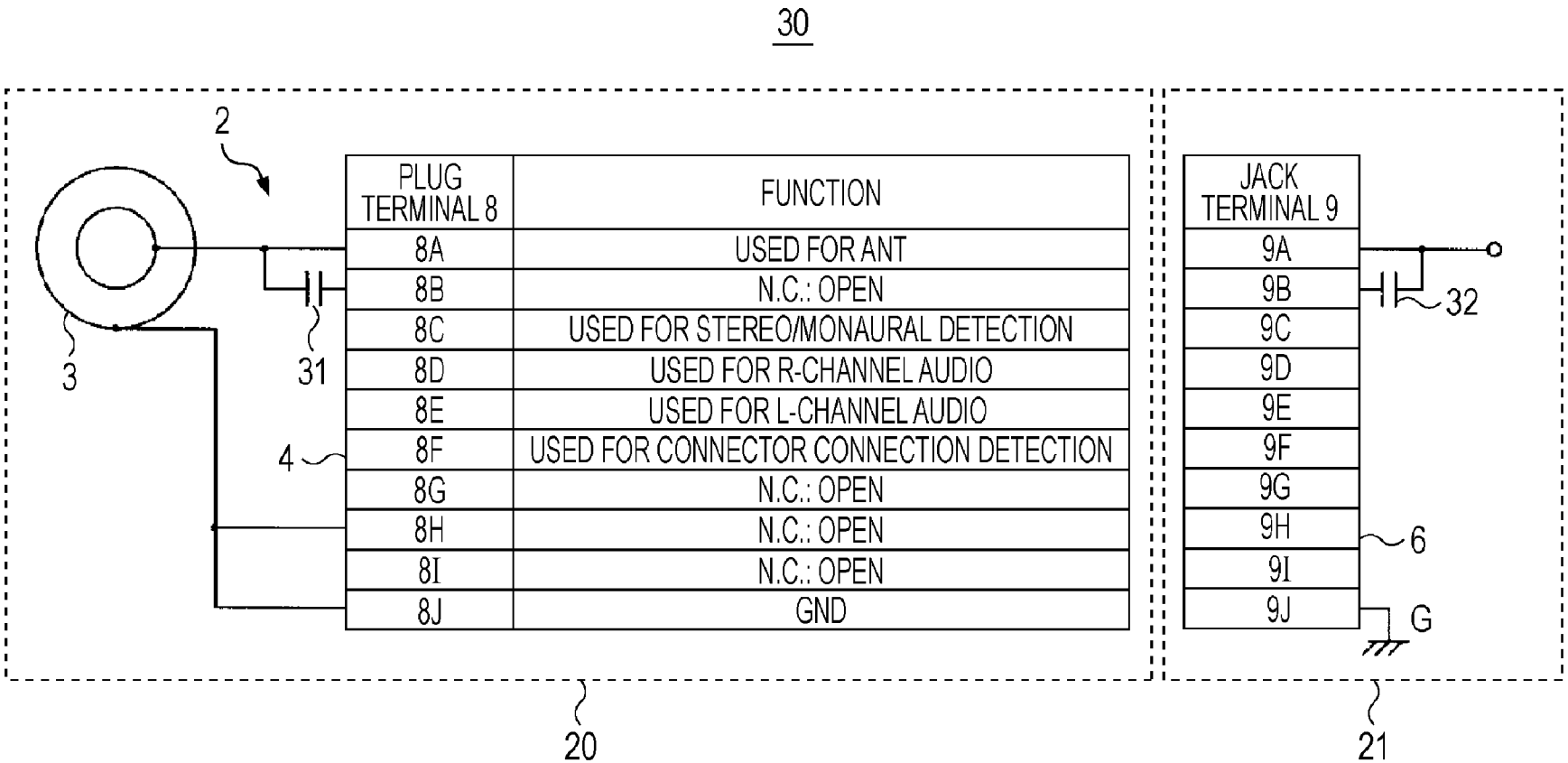
FIG. 7 is a schematic diagram of an application example in which a mobile phone and an antenna are connected via a transmission cable according to a third embodiment of the present invention.

Embodiments of the present invention are not limited to the foregoing embodiments, and may further include, for example, a multi-pin connector section 30 shown in FIG. 7 according to a third embodiment of the present invention in which only the RF signal feed line is enhanced, thereby reducing transmission loss to allow efficient transmission of an RF signal. The multi-pin connector section 30 is configured such that a capacitively-coupled plug terminal is formed in the transmission cable 20 by capacitively coupling the second plug terminal 8B, which is an open terminal, in parallel to the first plug terminal 8A, which is used for feeding an RF signal, via a ninth capacitor 31. In the multi-pin connector section 30, a capacitively-coupled grounding jack terminal is also formed in the mobile phone 21 by capacitively coupling the second jack terminal 9B connected to the second plug terminal 8B, which is an open terminal, in parallel via a tenth capacitor 32 to the first jack terminal 9A connected to the first plug terminal 8A, which is used for feeding an RF signal.

Figure 8:
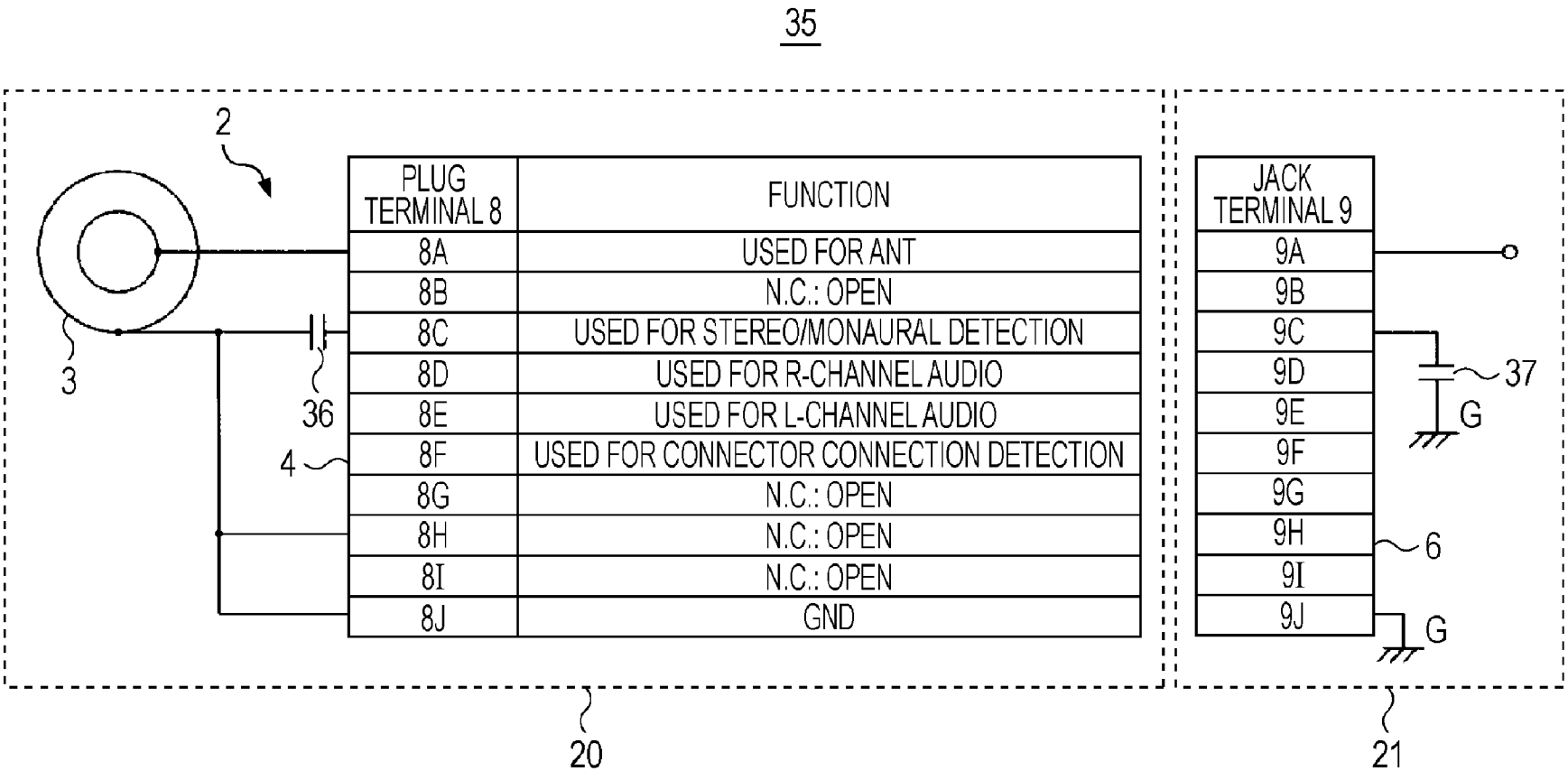
FIG. 8 is a schematic diagram of an application example in which a mobile phone and an antenna are connected via a transmission cable according to a fourth embodiment of the present invention.

FIG. 8 shows a multi-pin connector section 35 according to a fourth embodiment of the present invention in which only the ground line is enhanced in the RF signal transmission system and transmission loss is reduced to allow efficient transmission of an RF signal. The multi-pin connector section 35 is configured such that a capacitively-coupled grounding plug terminal is formed in the transmission cable 20 by capacitively coupling the third plug terminal 8C, which is used for stereo/monaural detection, in parallel to the tenth plug terminal 8J, which is used for grounding, via an 11th capacitor 36. The multi-pin connector section 35 is further configured such that a capacitively-coupled grounding jack terminal is also formed in the mobile phone 21 by capacitively coupling the third jack terminal 9C connected to the third plug terminal 8C, which is used for stereo/monaural detection, in parallel to the tenth jack terminal 9J connected to the tenth plug terminal 8J, which is used for grounding, via a 12th capacitor 37. Also in the multi-pin connector section 35, a stereo/monaural detection signal, which is a DC signal, flowing between the connected third plug terminal 8C and third jack terminal 9C is filtered by the 11th and 12th capacitors 36 and 37 with respect to the tenth plug terminal 8J and the tenth jack terminal 9J. Therefore, there is no effect on a transmission system of a stereo/monaural detection signal.

Figure 9:
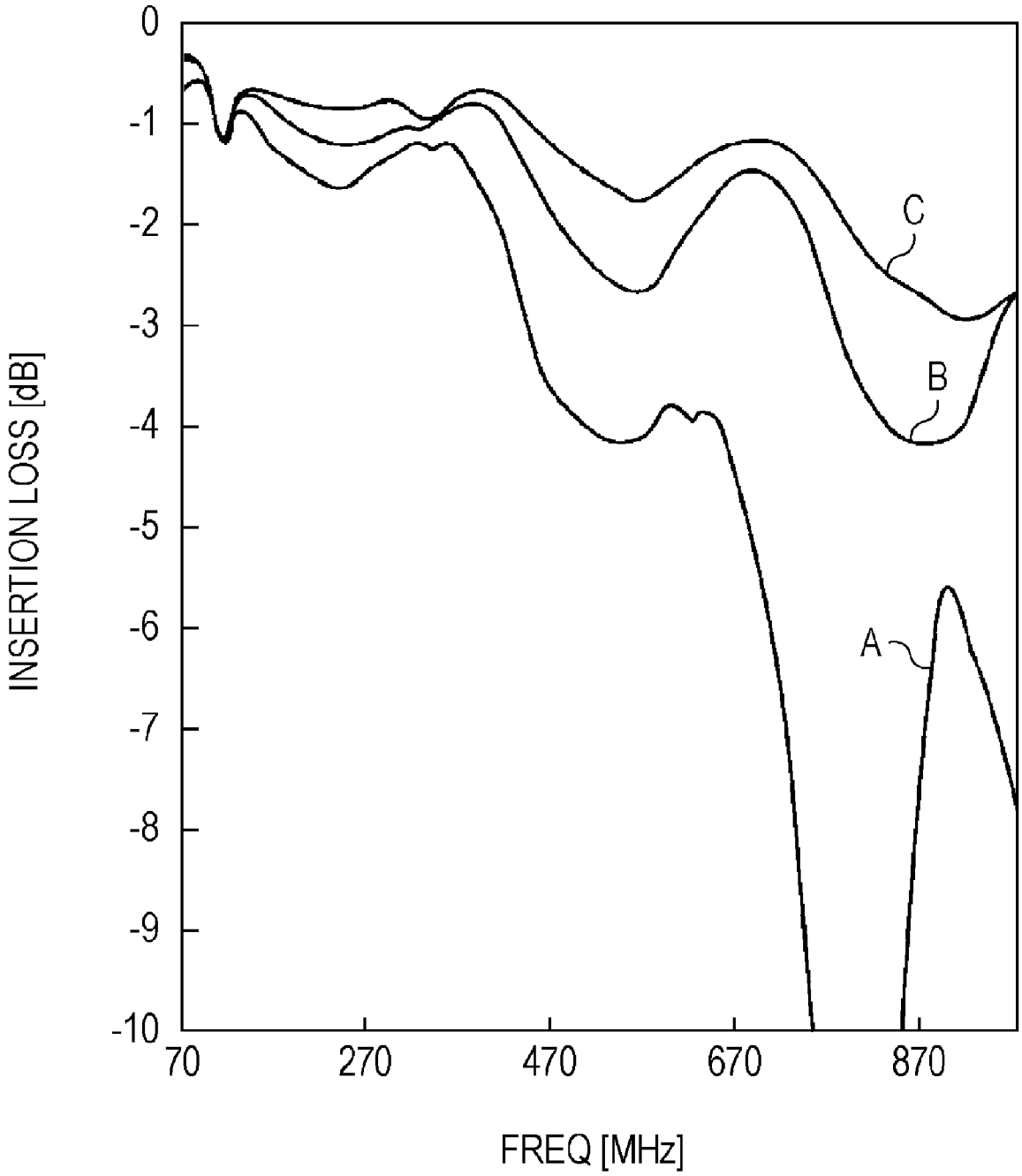
FIG. 9 is a diagram showing characteristic evaluation of multi-pin connector sections.

FIGS. 9 and 10 are diagrams showing a result of evaluation of transmission loss of an RF signal in the multi-pin connector section 22 according to the second embodiment configured to enhance the RF signal feed line and the ground line, the multi-pin connector section 35 according to the fourth embodiment configured to enhance the ground line, and the multi-pin connector section of the existing transmission cable 105. The evaluation of transmission loss of an RF signal was performed by connecting capacitors each having a capacitance of 1000 pF to each of the multi-pin connector sections 22 and 35, inputting signals of frequency bands from the high-frequency connector section 3, and measuring a level of an output signal from the plug section 4.

In FIG. 9, curve A represents a result of evaluation of transmission loss of an RF signal in the multi-pin connector section of the existing transmission cable 105. Curve B represents a result of evaluation of transmission loss of an RF signal in the multi-pin connector section 35 configured to enhance only the ground line. Curve C represents a result of evaluation of transmission loss of an RF signal in the multi-pin connector section 22 configured to enhance both the RF signal feed line and the ground line.

As is apparent from FIGS. 9 and 10, the existing transmission cable 105 and the multi-pin connector sections 22 and 35 have a characteristic in which, as described above, due to the inductor components, which are given by $Z=j2\pi fL$, of the individually connected plug terminals and jack terminals, the transmission loss increases as the frequency band becomes higher. Both the multi-pin connector sections 22 and 35 having the configurations described above achieve a reduction of the inductance components of the plug terminals and the jack terminals and therefore achieve a reduction of transmission loss with respect to any frequency band compared with that of the existing transmission cable 105. The multi-pin connector section 22 configured to enhance the RF signal feed line and the ground line significantly reduces transmission loss because it achieves the enhancement of the RF signal feed line and the ground line, compared with the multi-pin connector section 35 configured to enhance only the ground line.

Figure 11:
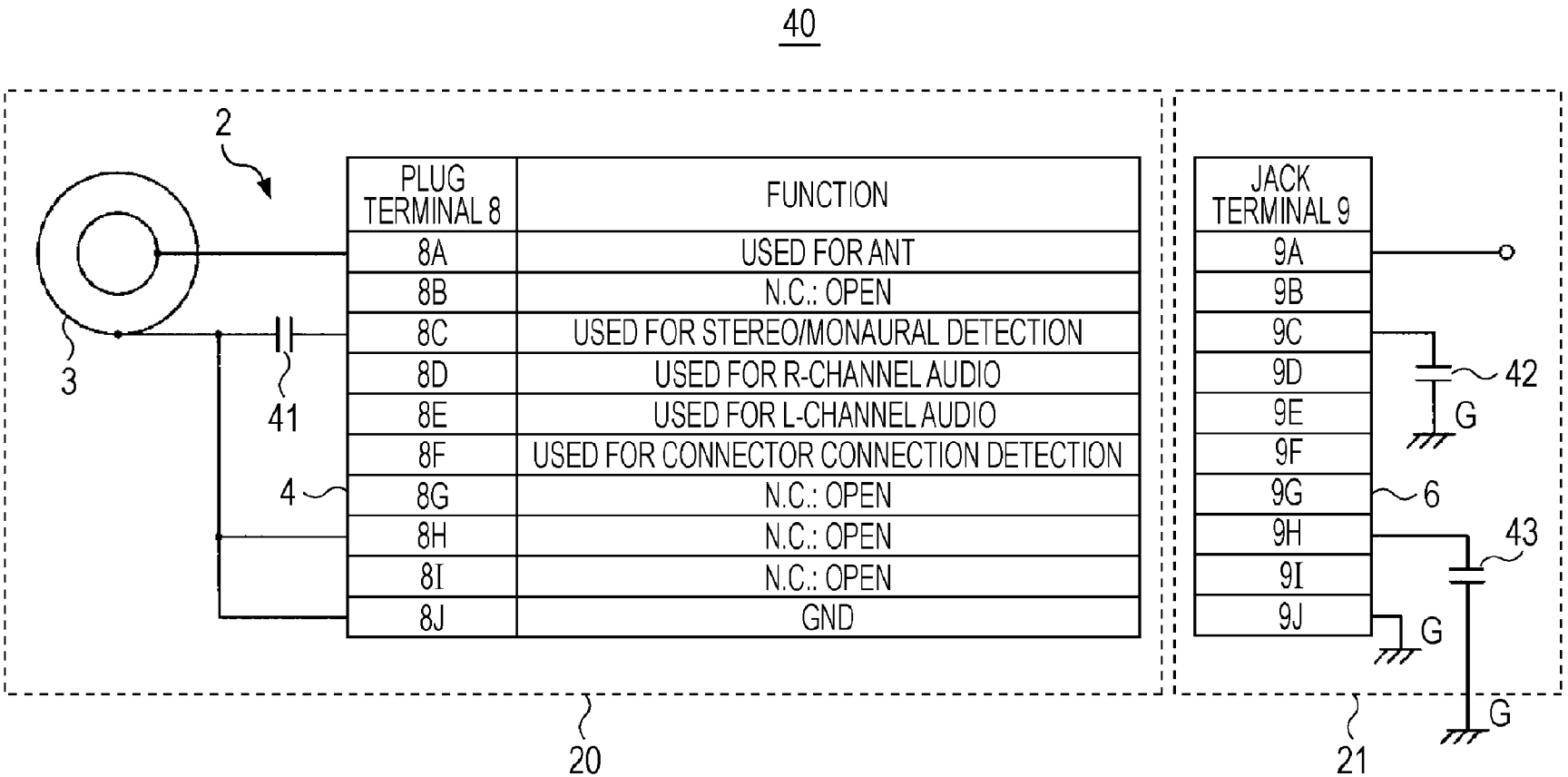
FIG. 11 is a schematic diagram of an application example in which a mobile phone and an antenna are connected via a transmission cable according to a fifth embodiment of the present invention.

FIG. 11 shows a multi-pin connector section 40 according to a fifth embodiment of the present invention in which a band elimination filter function is realized by combining the inductor components of the plug terminals 8 and jack terminals 9 with capacitors having a predetermined capacitance that constitute a capacitively-coupled grounding plug terminal and capacitively-coupled grounding jack terminal. The multi-pin connector section 40 is configured such that, in the transmission cable 20, the tenth plug terminal 8J, which is used for grounding, is capacitively coupled in parallel to the third plug terminal 8C, which is used for stereo or monaural detection, via a 13th capacitor 41, and is also connected in parallel to the eighth plug terminal 8H, which is an open terminal. In the multi-pin connector section 40, a ground line for an RF signal that is constructed with such a capacitively-coupled grounding plug terminal configuration in the transmission cable 20 allows a one-third reduction in the inductance component of the grounding plug terminal.

The multi-pin connector section 40 is configured such that, in the mobile phone 21, the tenth jack terminal 9J connected to the tenth plug terminal 8J, which is used for grounding, is capacitively coupled in parallel to the third jack terminal 9C connected to the third plug terminal 8C, which is used for stereo/monaural detection, via a 14th capacitor 42, and is also capacitively coupled in parallel to the eighth jack terminal 9H connected to the eighth plug terminal 8H, which is an open terminal, via a 15th capacitor 43. In the multi-pin connector section 40, a ground line for an RF signal that is constructed with such a capacitively-coupled grounding jack terminal configuration in the mobile phone 21 also allows a one-third reduction in the inductance component of the grounding jack terminal.

Figure 12:
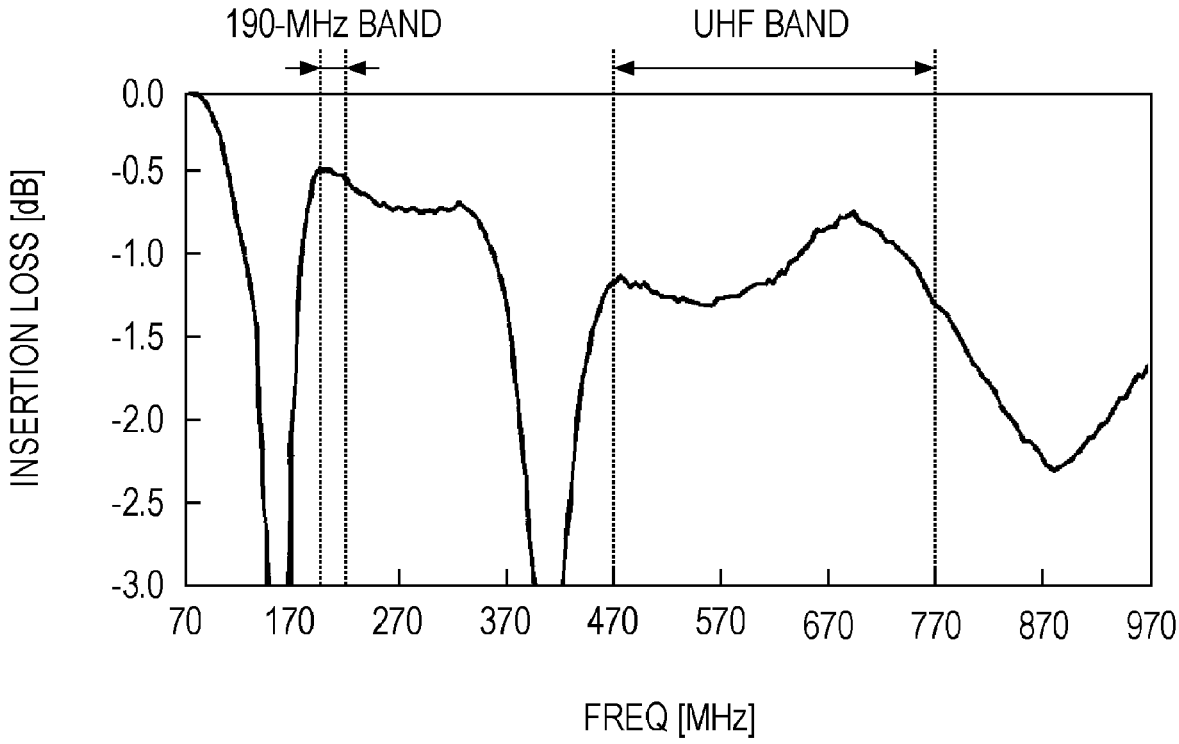
FIG. 12 is a characteristic diagram of a band elimination filter of a multi-pin connector section shown in FIG. 11.

In the multi-pin connector section 40, the 13th capacitor 41 of the transmission cable 20 may be a capacitor having a capacitance of 1000 pF, and the 14th and 15th capacitors 42 and 43 of the mobile phone 21 may be capacitors having capacitances of 10 pF and 27 pF, respectively. By connecting the plug section 4 to the input/output terminal section 6, the multi-pin connector section 40 achieves a band elimination filter function shown in FIG. 12 that allows frequency signals of approximately the 150 MHz band and 450 MHz band to be selectively rejected.

Figure 14:
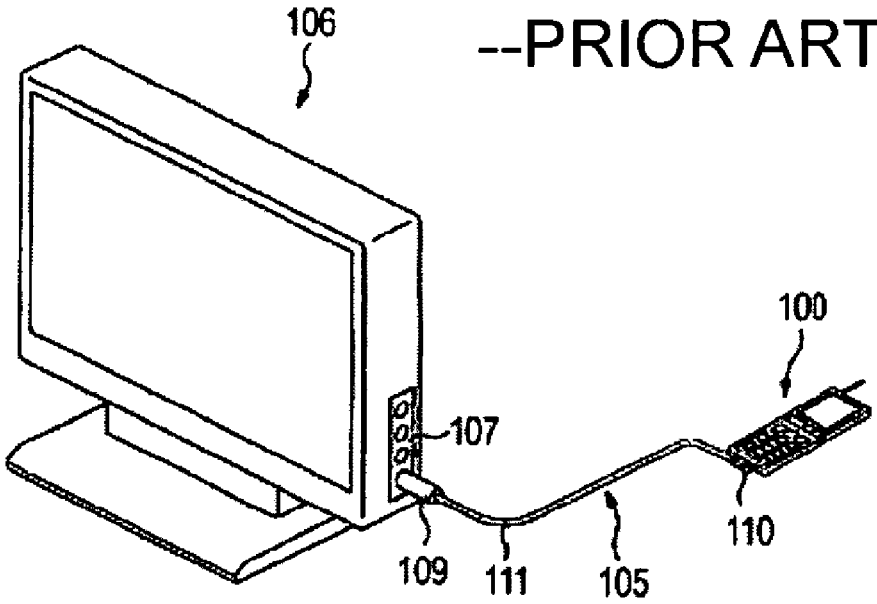
FIG. 14 is a diagram showing a use state of a signal transmission cable connected to a mobile phone and a television receiver.
Figure 17:
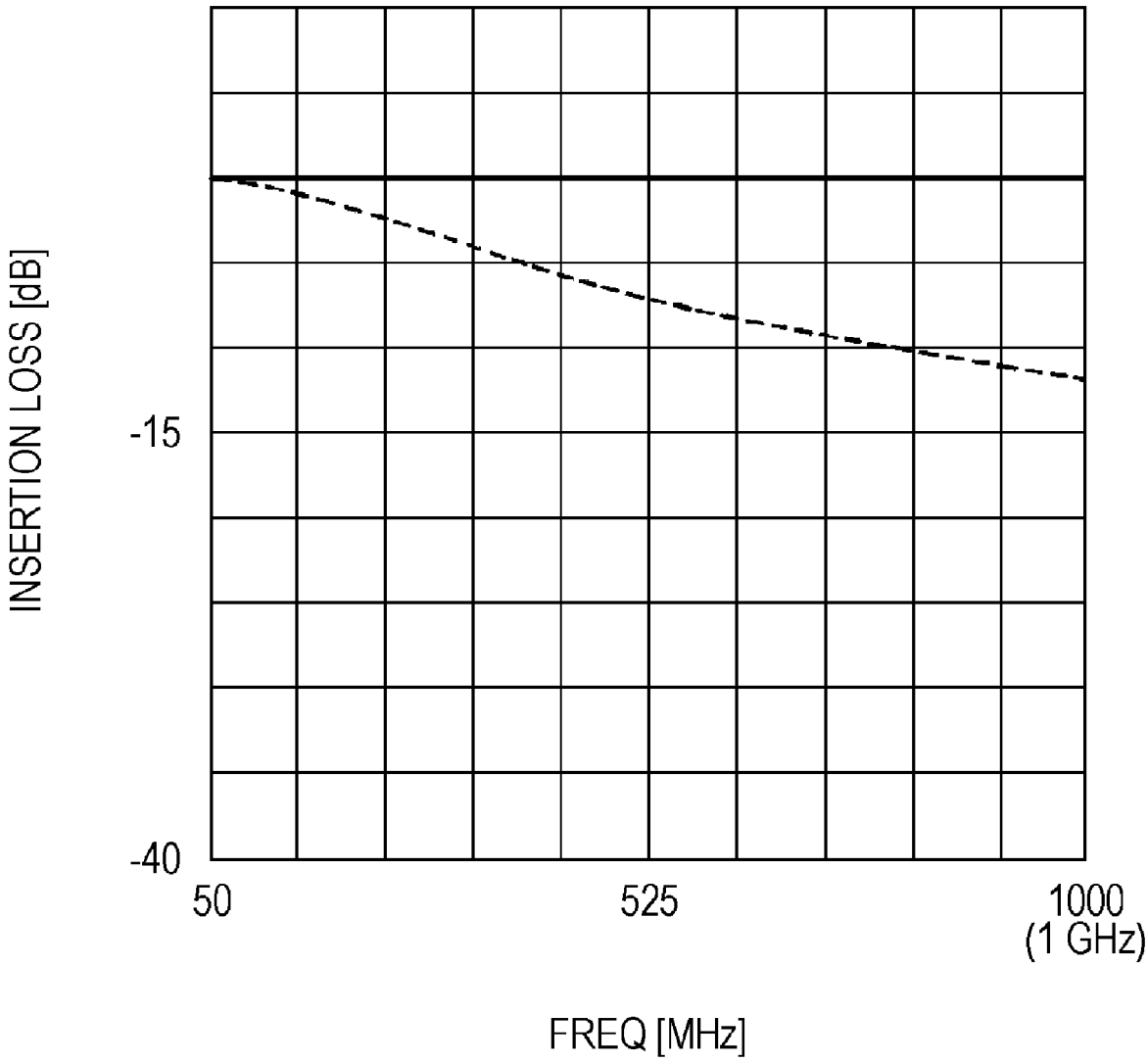
FIG. 17 is a transmission characteristic diagram of the existing multi-pin connector section.

Therefore, the multi-pin connector section 40 improves transmission characteristics of signals of the frequency modulation (FM) radio band up to the ultra high frequency (UHF) band (50 MHz to 1 GHz) without using a band-pass filter element, and achieves a reduction in the size and cost thereof. In the multi-pin connector section 40, conditions of selection of frequencies for the band elimination filter function are appropriately set so that, for example, unwanted waves emitted from the mobile phone 21 can be removed when the mobile phone 21 transmits recording information to an antenna for receiving television broadcast programs or a television receiver such as the television receiver 106 shown in FIG. 14.

It is to be understood that embodiments of the present invention are not limited to an application example in which the above-described mobile phones and various antennas are connected via transmission cables. Other embodiments of the present invention provide connection structures for connecting various electronic apparatuses via a multi-pin connector section to transmit both a low-frequency signal and a high-frequency signal therebetween, e.g., as described above, a connection structure for connecting a mobile phone and a television receiver via a transmission cable.

It should be understood by those skilled in the art that various modifications, combinations, sub-combinations and alterations may occur depending on design requirements and other factors insofar as they are within the scope of the appended claims or the equivalents thereof.

What is claimed is:

1. A connection structure comprising:

a plug assembly including at least three plug terminals; and a jack assembly including at least three jack terminals associated with and connected to the plug terminals, wherein the plug assembly and the jack assembly form a multi-pin connector section configured to transmit and receive a signal, at least one pair of plug terminals of the plug terminals in the plug assembly is capacitively coupled in parallel to form a capacitively-coupled plug terminal, and at least one pair of jack terminals of the jack terminals in the jack assembly, the pair of jack terminals being associated with and connected to the pair of plug terminals, is capacitively coupled in parallel to form a capacitively-coupled jack terminal, and the capacitively-coupled plug terminal and the capacitively-coupled jack terminal are connected to transmit and receive a high-frequency signal.

2. The connection structure according to claim 1, wherein the capacitively-coupled plug terminal is formed by capacitively coupling at least one pair of plug terminals of the plug terminals, the pair of plug terminals including a plug terminal for a feed line of a high-frequency signal and a selected one of the plug terminals that has another function, and the capacitively-coupled jack terminal is formed by capacitively coupling at least one pair of jack terminals of the jack terminals, the pair of jack terminals being associated with and connected to the pair of plug terminals and including a jack terminal for a feed line of a high-frequency signal and a selected one of the jack terminals that has another function.

3. The connection structure according to claim 1, wherein the capacitively-coupled plug terminal is formed by capacitively coupling at least one pair of plug terminals of the plug terminals, the pair of plug terminals including a plug terminal for a ground line and a selected one of the plug terminals that has another function, and the capacitively-coupled jack terminal is formed by capacitively coupling at least one pair of jack terminals of the jack terminals, the pair of jack terminals being associated with and connected to the pair of plug terminals and including a jack terminal for a ground line and a selected one of the jack terminals that has another function.

4. The connection structure according to claim 1, wherein the at least one pair of plug terminals is capacitively coupled in parallel via a plug-side capacitor to form the capacitively-coupled plug terminal, and the at least one pair of jack terminals is capacitively coupled in parallel via a jack-side capacitor to form the capacitively-coupled jack terminal, and each of the plug-side capacitor and the jack-side capacitor has a predetermined capacitance for forming a band elimination filter that is configured to select a predetermined frequency band using an inductance component of each of the plug terminals and jack terminals.

5. A signal transmission cable comprising:

a plug section including at least three plug terminals;

a high-frequency connector section configured to be connected to a connection section of an electronic apparatus to input and output a signal including a high-frequency signal; and a cable section connecting the plug section and the high-frequency connector section, wherein the plug section is configured to be connected to a jack assembly provided in the electronic apparatus to form a multi-pin connector section configured to transmit and receive a signal, the jack assembly including at least three jack terminals that are associated with the plug terminals, at least one pair of jack terminals of the jack terminals being capacitively coupled in parallel to form a capacitively-coupled jack terminal, a capacitively-coupled plug terminal is formed in the plug section by capacitively coupling, in parallel, at least one pair of plug terminals of the plug terminals that is associated with the pair of jack terminals capacitively coupled to form the capacitively-coupled jack terminal in the jack assembly, and the plug section is connected to the jack assembly to connect the capacitively-coupled plug terminal to the capacitively-coupled jack terminal to transmit and receive a high-frequency signal.

* * * * *